US009624932B2

(12) United States Patent
Jeon et al.

(10) Patent No.: US 9,624,932 B2
(45) Date of Patent: Apr. 18, 2017

(54) CENTRIFUGAL FAN AND AIR CONDITIONER HAVING THE SAME

(71) Applicant: SAMSUNG ELECTRONICS CO., LTD., Suwon-si, Gyeonggi-do (KR)

(72) Inventors: Hyun Joo Jeon, Yongin-si (KR); Dae Gyu Kang, Suwon-si (KR); Seon Uk Na, Yongin-si (KR); Yong Ho Seo, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 415 days.

(21) Appl. No.: 14/220,809

(22) Filed: Mar. 20, 2014

(65) Prior Publication Data

US 2014/0286800 A1 Sep. 25, 2014

(30) Foreign Application Priority Data

Mar. 20, 2013 (KR) ..... 10-2013-0029971

(51) Int. Cl.
*F04D 17/10* (2006.01)
*F04D 29/28* (2006.01)
(Continued)

(52) U.S. Cl.
CPC ..... *F04D 17/10* (2013.01); *F04D 29/283* (2013.01); *F04D 29/422* (2013.01); *F04D 29/424* (2013.01); *F24F 1/0022* (2013.01)

(58) Field of Classification Search
CPC ..... F04D 17/10; F04D 29/283; F04D 29/422; F04D 29/424; F24F 1/0022
See application file for complete search history.

(56) References Cited

U.S. PATENT DOCUMENTS 6,844,638 B2 1/2005 Vasilescu
2004/0219013 A1 11/2004 Hopfensperger
(Continued)

FOREIGN PATENT DOCUMENTS

EP 1 384 894 A2 1/2004
EP 1 384 894 A3 1/2005
(Continued)

OTHER PUBLICATIONS

European Search Report issued Aug. 26, 2014 in corresponding European Application No. 14160848.9.
(Continued)

*Primary Examiner* — Audrey K Bradley
(74) *Attorney, Agent, or Firm* — Staas & Halsey LLP

(57) ABSTRACT

An air blowing unit of an air conditioner includes a housing to guide suction and discharge of air, a centrifugal fan positioned inside the housing, and a motor to drive the centrifugal fan. The centrifugal fan includes a base coupled to a motor shaft coupled to the motor, a plurality of blades disposed spaced apart from each other in a circumferential direction of the base to guide air introduced in an axial direction of the base to the circumferential direction, a leading edge provided to the blades and arranged close to the motor shaft, a trailing edge provided to the blades and facing in an outer circumferential direction of the base, and at least one first blade of the blades, the leading edge of the first blade being shorter than the leading edge of the other blades.

13 Claims, 12 Drawing Sheets

(51) Int. Cl.
*F04D 29/42* (2006.01)
*F24F 1/00* (2011.01)

(56) References Cited

U.S. PATENT DOCUMENTS

| | | | | |
|---|---|---|---|---|
| 2005/0191174 | A1* | 9/2005 | Zeng | F04D 29/162 415/206 |
| 2006/0086734 | A1* | 4/2006 | Song | H05B 6/6423 219/757 |
| 2007/0130980 | A1* | 6/2007 | Han et al. | F24F 1/0011 62/262 |
| 2008/0193285 | A1 | 8/2008 | Spaggiari | |
| 2009/0145583 | A1* | 6/2009 | Han | F04D 29/282 165/121 |
| 2010/0040456 | A1 | 2/2010 | Hwang et al. | |

FOREIGN PATENT DOCUMENTS

| | | | | |
|---|---|---|---|---|
| EP | 1 953 391 | A1 | 8/2008 | |
| EP | 2 261 511 | A2 | 12/2010 | |
| EP | 2 261 511 | A3 | 7/2014 | |
| GB | 2393220 | A * | 3/2004 | F04D 29/422 |
| JP | 2-52019 | | 2/1990 | |
| JP | 10220398 | A * | 8/1998 | |
| JP | 2006-77631 | | 3/2006 | |
| JP | 2009-203897 | | 9/2009 | |
| JP | 2011-226410 | | 11/2011 | |
| JP | 2011226410 | A * | 11/2011 | |
| KR | 10-2005-0044972 | | 5/2005 | |
| KR | 10-2006-0089125 | | 8/2006 | |
| KR | 20060089125 | A * | 8/2006 | |
| KR | 10-2007-0087298 | | 8/2007 | |
| KR | 10-2010-0085235 | | 7/2010 | |
| WO | WO98/53211 | | 11/1998 | |

OTHER PUBLICATIONS

International Search Report issued Jun. 19, 2014 in corresponding PCT Application No. PCT/KR2014/002267.
Australian Notice of Acceptance dated Jul. 26, 2016 from Australian Patent Application No. 2014238673, 2 pages.
European Office Action dated Jul. 25, 2016 from European Patent Application No. 14160848.9, 6 pages.
Russian Office Action dated Nov. 17, 2016 from Russian Patent Application No. 2015139892/12, 8 pages.

* cited by examiner

CENTRIFUGAL FAN AND AIR CONDITIONER HAVING THE SAME

CROSS-REFERENCE TO RELATED APPLICATIONS

This application claims the benefit of Korean Patent Application No. 10-2013-0029971, filed on Mar. 20, 2013 in the Korean Intellectual Property Office, the disclosure of which is incorporated herein by reference.

BACKGROUND

1. Field

Embodiments of the present disclosure relate to a centrifugal fan provided with an improved structure or an improved housing to reduce flow loss in various ranges of static pressure and an air conditioner having the same.

2. Description of the Related Art

In general, an air conditioner is an apparatus that ventilates or cools an indoor space by discharging air into the indoor space. Various filters are disposed in the air conditioner to filter air. Since the filters resist flow of air in the air conditioner, a centrifugal fan, which generates a high static pressure relative to other kinds of fans, is applied to an air conditioner requiring a high flow rate.

The centrifugal fan causes a fluid suctioned in an axial direction to be forcibly blown according to rotation of blades. In the case of the centrifugal fan, the blades are integrally formed through injection molding in both directions, and accordingly it is difficult to change the shape of the centrifugal fan. In addition, high flow rate may be secured by shortening the length of blades and providing a small number of blades. However, to secure high flow rate at a high static pressure, the length of the blades may need to be increased and the number of blades may need to be increased. Accordingly, it has been difficult to fabricate a centrifugal fan securing both high flow rate and high static pressure.

SUMMARY

Therefore, it is an aspect of the present disclosure to provide a centrifugal fan provided with an improved structure or a housing having an improved structure to reduce resistance produced at high static pressure and provide high flow rate.

Additional aspects of the disclosure will be set forth in part in the description which follows and, in part, will be apparent from the description, or may be learned by practice of the disclosure.

In accordance with one aspect of the present disclosure, an air conditioner includes a cabinet forming an external appearance of the air conditioner and an air blowing unit positioned inside the cabinet, wherein the air blowing unit includes a housing to guide suction and discharge of air, a centrifugal fan positioned inside the housing, and a motor to drive the centrifugal fan, wherein the centrifugal fan includes a base coupled to a motor shaft coupled to the motor, a plurality of blades disposed spaced apart from each other in a circumferential direction of the base to guide air introduced in an axial direction of the base to the circumferential direction of the base, a leading edge provided to each of the blades and arranged close to the motor shaft, a trailing edge provided to each of the blades and facing in an outer circumferential direction of the base, and at least one first blade included in the blades, the leading edge of the first blade being shorter than the leading edge of each of the other blades.

The first blade and at least one second blade of the blades may be alternately disposed, the leading edge of the second blade being longer than the leading edge of the first blade.

A plurality of first blades of the at least one first blade may be disposed between second blades of the blades, the leading edge of each of the second blades being longer than the leading edge of each of the first blades.

A bending angle of the trailing edge of the first blade may be greater than a bending angle of the trailing edge of each of the other blades.

The housing may include a housing discharge port allowing air to be discharged therethrough, wherein at least one portion of the housing discharge port is formed as a curved surface and includes a protrusion protruding upward of the housing.

The protrusion may be arranged at both edges of the housing discharge port.

The protrusion may be arranged at a central portion of the housing discharge port.

The protrusion may protrude in a radial direction of the centrifugal fan.

The protrusion may protrude in a circumferential direction of the centrifugal fan.

In accordance with another aspect of the present disclosure, an air conditioner includes a cabinet forming an external appearance of the air conditioner and an air blowing unit positioned inside the cabinet, wherein the air blowing unit includes a housing to guide suction and discharge of air, a centrifugal fan positioned inside the housing, and a motor to drive the centrifugal fan, wherein the centrifugal fan includes a base coupled to a motor shaft coupled to the motor, and a plurality of blades disposed spaced apart from each other in a circumferential direction of the base to guide air introduced in an axial direction of the base to the circumferential direction of the base, wherein at least one of a suction angle and a discharge angle of the air suctioned into and discharged from the blades differs between at least one of the blades and the other blades.

The suction angle of the air may differ between at least one first blade of the blades and the other blades, wherein a leading edge of the first blade arranged close to the motor shaft may be shorter than a leading edge provided to the other blades.

The discharge angle of the air may differ between at least one first blade of the blades and the other blades, wherein a trailing edge of the first blade arranged close to an outer circumference of the base may have a greater bending angle than a trailing edge provided to the other blades.

The housing may include a housing discharge port allowing air to be discharged therethrough, wherein at least one portion of a bottom surface of the housing discharge port may include a protrusion protruding to have a different distance from the centrifugal fan than the other portion of the bottom surface.

The protrusion may be arranged at both edges of the housing discharge port.

The protrusion may be arranged at a central portion of the housing discharge port.

In accordance with a further aspect of the present disclosure, a centrifugal fan includes a disc-shaped base, and a plurality of blades disposed spaced apart from each other in a circumferential direction of the base to guide air introduced in an axial direction of the base to the circumferential direction of the base, wherein at least one of a suction angle and a discharge angle of the air suctioned into and discharged from the blades differs between at least one of the blades and the other blades.

The suction angle of the air may differ between at least one first blade of the blades and the other blades, wherein a leading edge of the first blade arranged close to the motor shaft may be shorter than a leading edge provided to the other blades.

The discharge angle of the air may differ between at least one first blade of the blades and the other blades, wherein a trailing edge of the first blade arranged close to an outer circumference of the base may have a greater bending angle than a trailing edge provided to the other blades.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
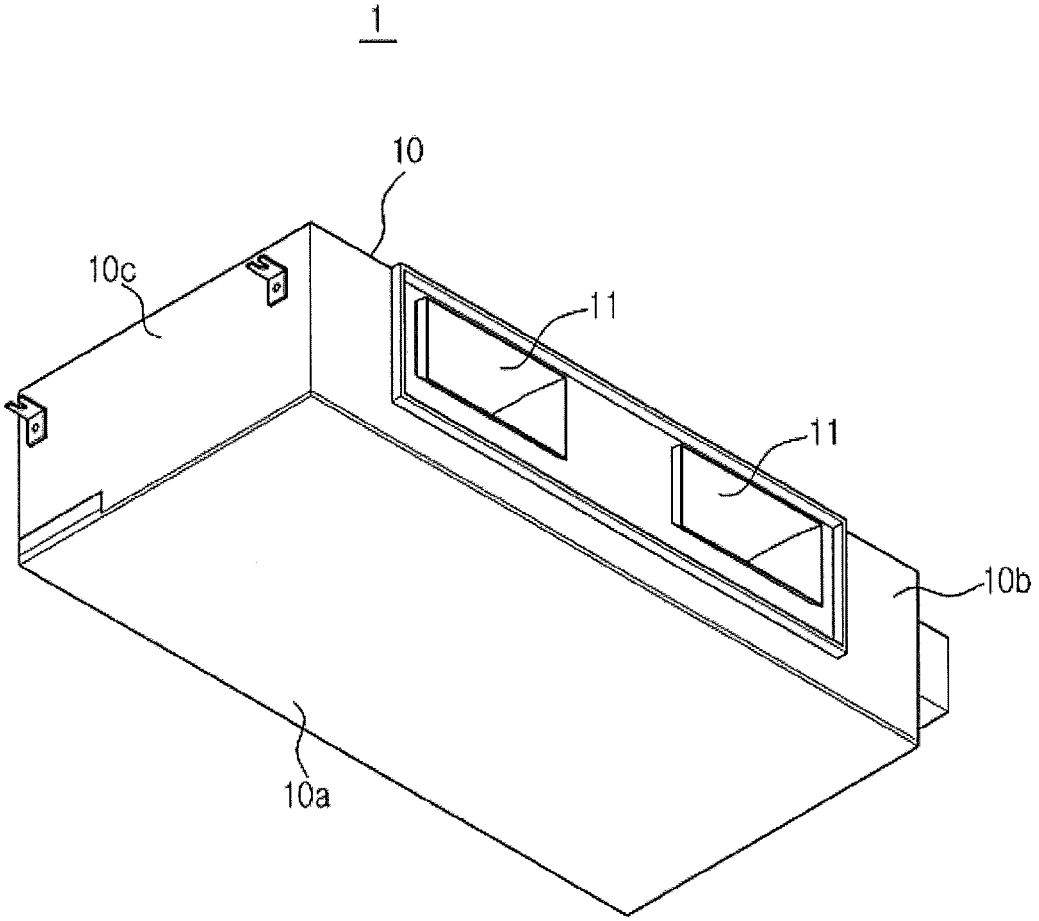
FIG. 1 is a view showing the external appearance of an air conditioner according to an exemplary embodiment of the present disclosure.

Reference will now be made in detail to the embodiments of the present disclosure, examples of which are illustrated in the accompanying drawings, wherein like reference numerals refer to like elements throughout. Hereinafter, a ceiling-mounted type air conditioner will be described as an example. However, embodiments of the present disclosure are not limited thereto.

Figure 2:
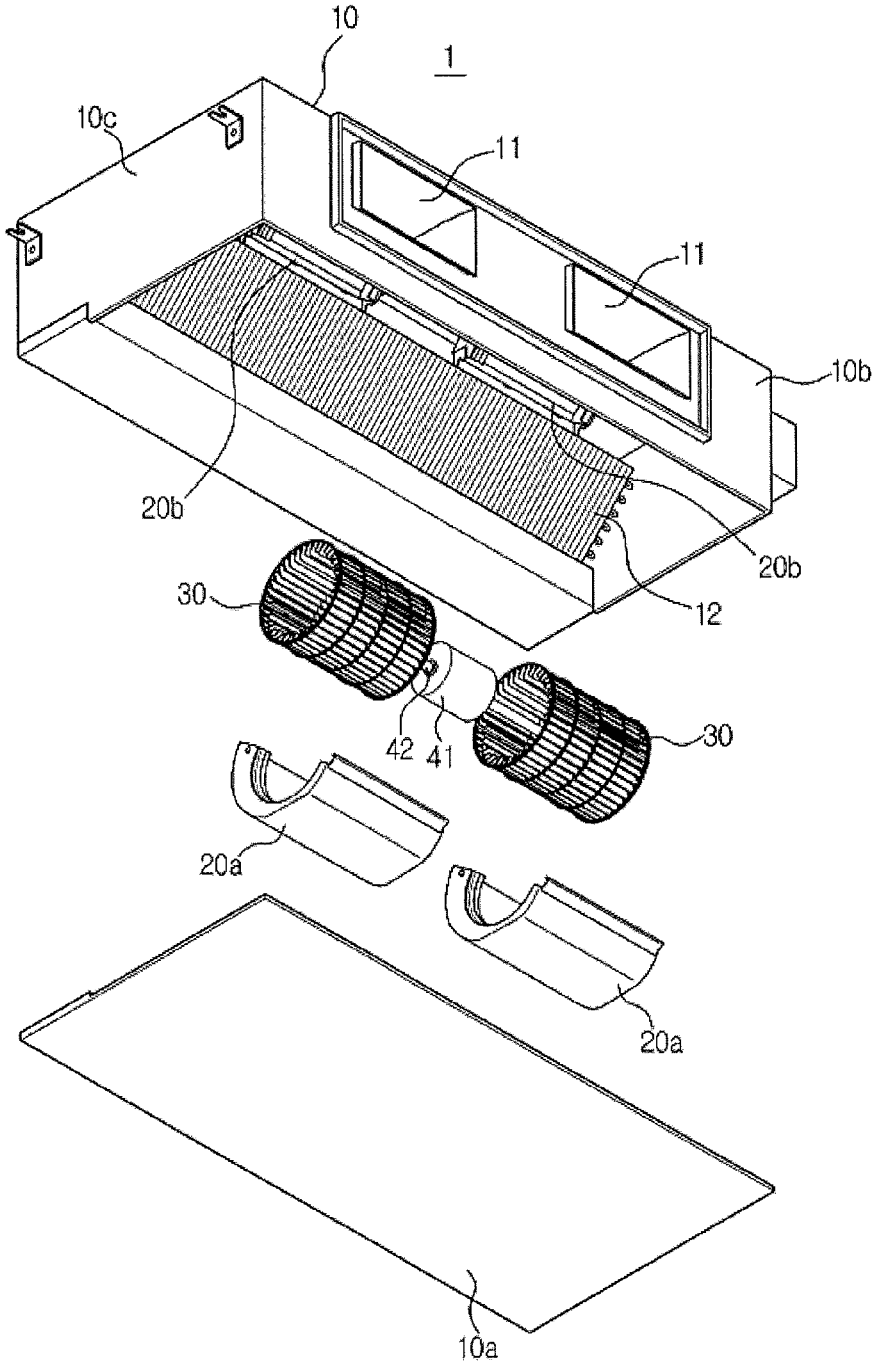
FIG. 2 is an exploded view illustrating an air conditioner according to one embodiment of the present disclosure.

FIG. 1 is a view illustrating an external appearance of an air conditioner according to one embodiment of the present disclosure, and FIG. 2 is an exploded view illustrating an air conditioner according to the embodiment.

As shown in FIGS. 1 and 2, the air conditioner 1 includes a cabinet 10 forming the external appearance of the air conditioner 1, a heat exchanger 12 installed inside the cabinet 10, and an air blowing unit 40 (see FIG. 4) positioned at the front of the heat exchanger 12. The air blowing unit 40 forcibly suctions air, while the heat exchanger 12 cools the suctioned air.

The cabinet 10 may include a lower face 10*a* to surround the lower face of the air conditioner 1, a lateral face 10*c* to surround both lateral surfaces of the air conditioner 1, a front face 10*b* to surround the front face of the air conditioner 1, and an upper face (not shown) to surround the upper face of the air conditioner.

A suction port (not shown) to suction air is arranged at one side of the cabinet 10, and a discharge port 11 to discharge the air is arranged at another side of the cabinet 10. A door (not shown) to open and close the discharge port 11 may be installed at the front of the discharge port 11.

The air blowing unit 40 includes a housing 20 (see FIG. 3) to guide suction and discharge of air, and a centrifugal fan 30 positioned inside the housing 20. The housing 20 may include a first housing 20*a*, and a second housing 20*b*. The first housing 20*a* is positioned at the upper side, and the second housing 20*b* is positioned at the lower side. Thereby, the housing 20 may surround the centrifugal fan 30. The air blowing unit 40 may include a motor 41 to drive the centrifugal fan 30. In FIGS. 1 and 2, two centrifugal fans 30 are provided. However, embodiments of the present disclosure are not limited thereto. It may be possible to provide only one centrifugal fan. The motor 41 is positioned between the centrifugal fans 30. The motor 41 and the centrifugal fan 30 may be coupled to each other through a motor shaft 42.

The housing 20 may include a housing suction port 24 to suction air and a housing discharge port 25 to discharge air. The housing suction port 24 may include a first suction port and a second suction port arranged at both sides of the housing 20, which will be described later.

The housing 20 may be provided with a scroll expansion pattern in which the internal flow path of the housing 20 gradually expands as it extends toward the housing discharge port 25. This is intended to cause the cross-sectional area of the internal flow path to increase as the path extends in the direction of flow of air.

Figure 3:
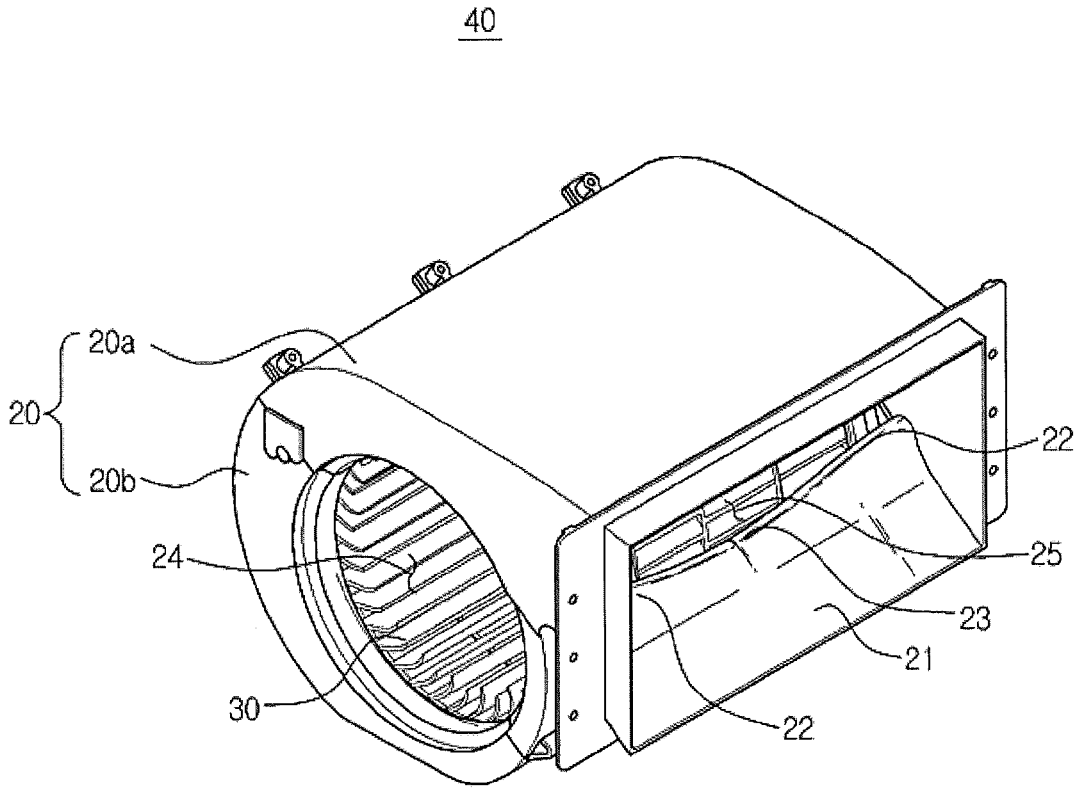
FIG. 3 is a view illustrating an air blowing unit according to one embodiment of the present disclosure.
Figure 4:
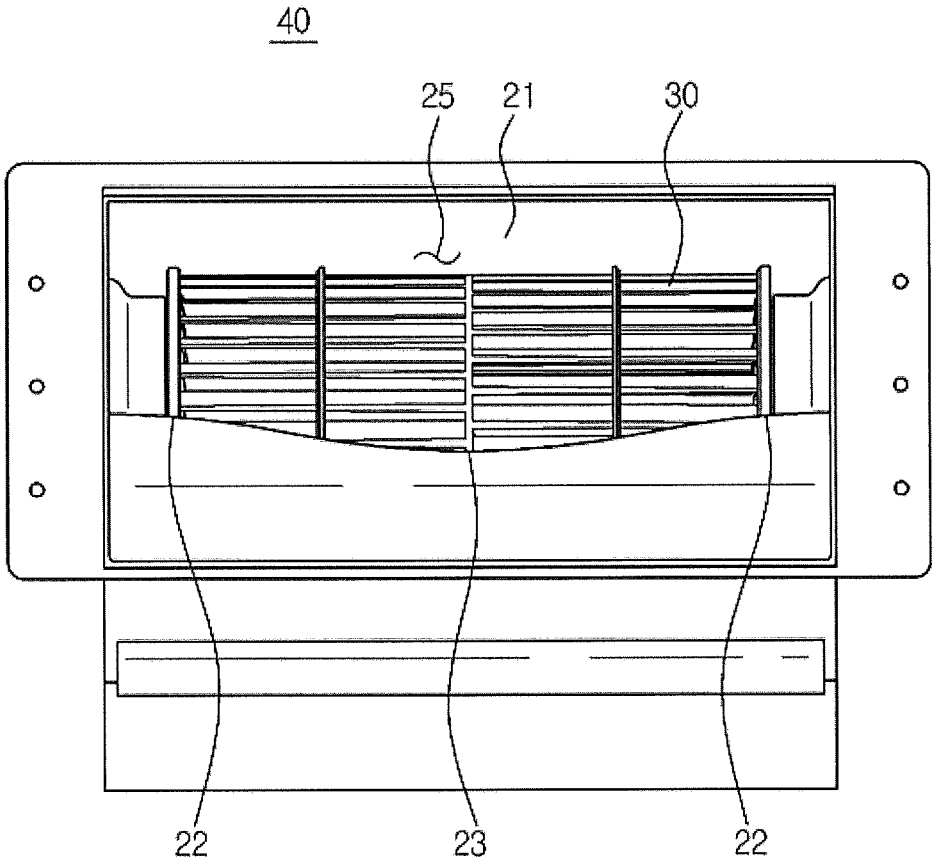
FIG. 4 is a view illustrating a discharge port of an air blowing unit according to one embodiment of the present disclosure.
Figure 5:
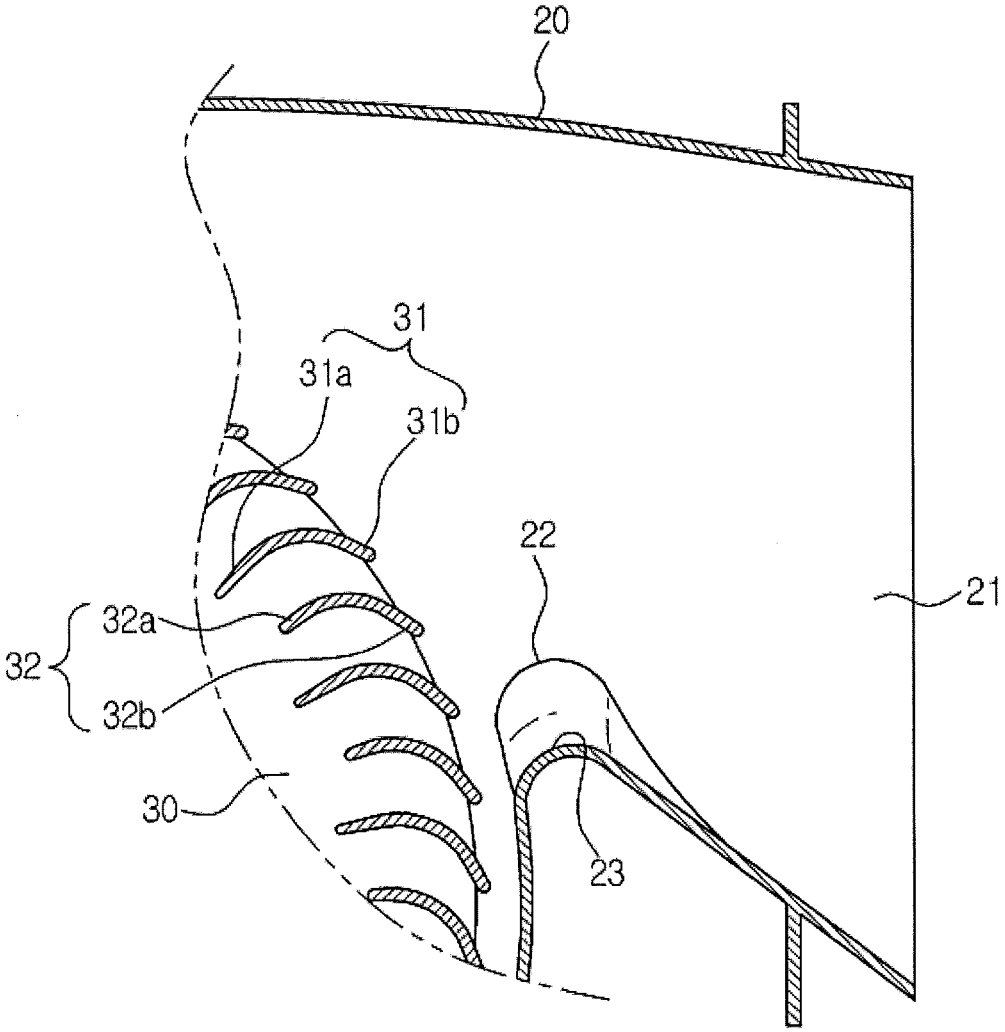
FIG. 5 is a view illustrating the cross section of the air blowing unit according to one embodiment.

FIG. 3 is a view illustrating an air blowing unit according to one embodiment of the present disclosure, FIG. 4 is a view illustrating a discharge port of the air blowing unit, and FIG. 5 is a view illustrating the cross section of the air blowing unit.

As shown in FIGS. 3 to 5, the air blowing unit 40 is configured with the centrifugal fan 30 and the housing surrounding the centrifugal fan 30. The housing 20 includes the first housing 20*a* and the second housing 20*b*. The centrifugal fan 30 may be positioned inside the first housing 20*a* and the second housing 20*b*, which are coupled to each other. The first suction port and the second suction port constructing the suction port 24 may be formed at both sides of the housing 20. In addition, the housing discharge port 25 to discharge the suctioned air may be formed in the front surface of the housing 20. Thereby, air suctioned into the housing 20 through the first suction port and second suction port according to operation of the centrifugal fan 30 may be discharged to the housing discharge port 25 and thus discharged through the front of the air conditioner 1.

In addition, the housing 20 may include a cut-off portion 21 adjoining the housing discharge port 25 to branch air flow. The cut-off portion 21 may be closest to the outer circumferential portion of the centrifugal fan 30.

A least one portion of the cut-off portion 21 may be provided with a curved surface. Particularly, at least one portion of the cut-off portion 21 may include a protrusion 22 protruding upward. According to this embodiment, the protrusion 22 may be provided to both edges of the housing discharge port 25. The protrusion 22 may protrude in the direction tangential to the circumference of the centrifugal fan 30. In addition, the protrusion 22 may protrude in a radial direction of the centrifugal fan 30. Thereby, the central portion 23 of the cut-off portion 21 may be concave.

Blades 31 and 32 of the centrifugal fan 30 will be described later with reference to FIGS. 5 and 6.

In the case of the centrifugal fan 30, the direction of discharge of the suctioned air is 90° from the suction direction. Thereby, vortices may be produced at both edges of the housing discharge port 25, thereby weakening the flow of air at both sides of the housing discharge port 25. On the other hand, the flow of air formed at the central portion of the housing discharge port 25 is strong.

According to one embodiment of the present disclosure, the distance by which the central portion of the housing discharge port 25 is spaced apart from the center of the centrifugal fan 30 has been increased to prevent loss of air flow due to change in shape of the cut-off portion 21 of the housing discharge port 25 and utilize the strong air flow created at the center 23 of the cut-off portion 21. Thereby, vortices created around the housing discharge port 25 may be reduced. Accordingly, resistance of air created at the center may be reduced and loss of air flow created at the edge portions may be reduced.

Figure 6:
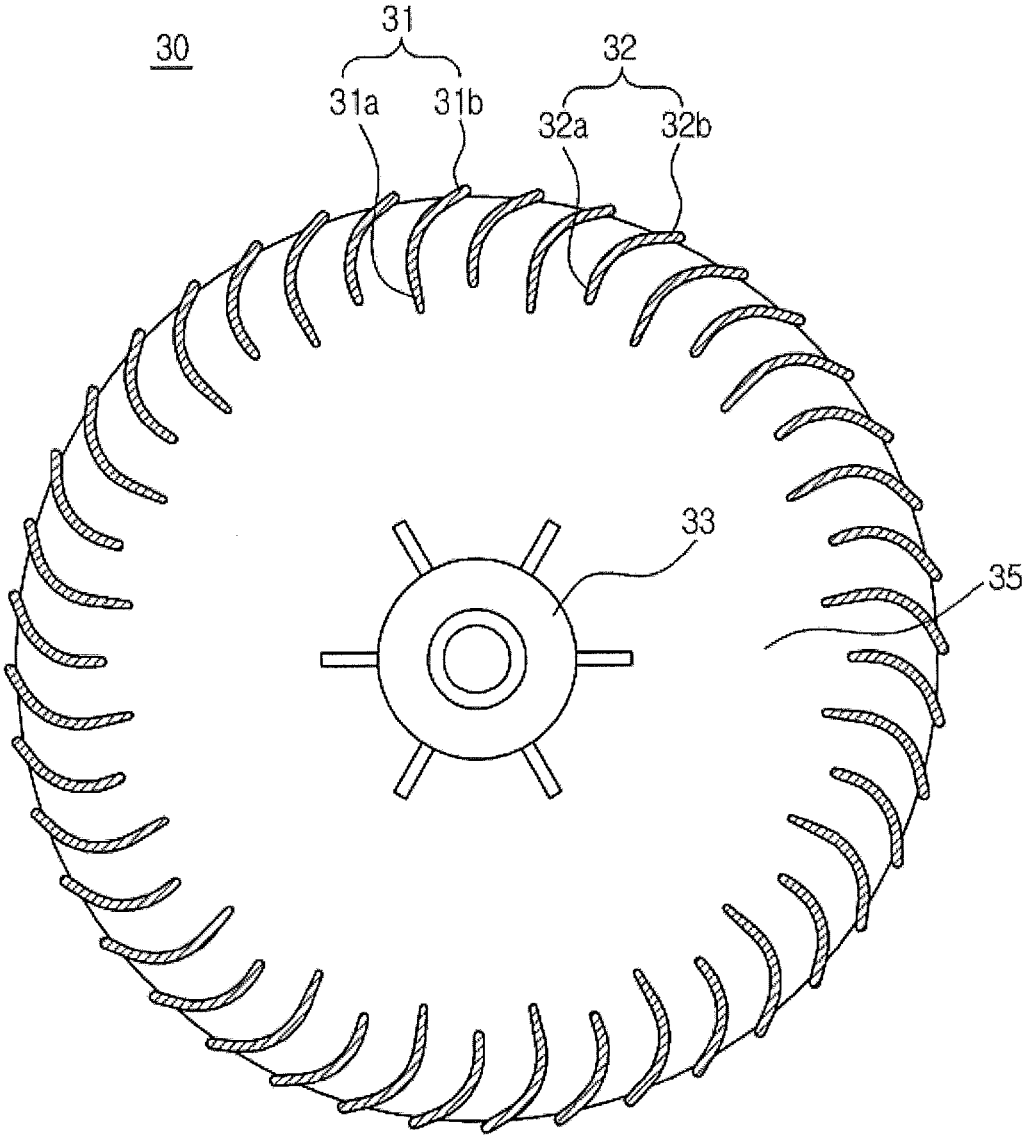
FIG. 6 is a view illustrating a centrifugal fan according to one embodiment of the present disclosure.
Figure 7:
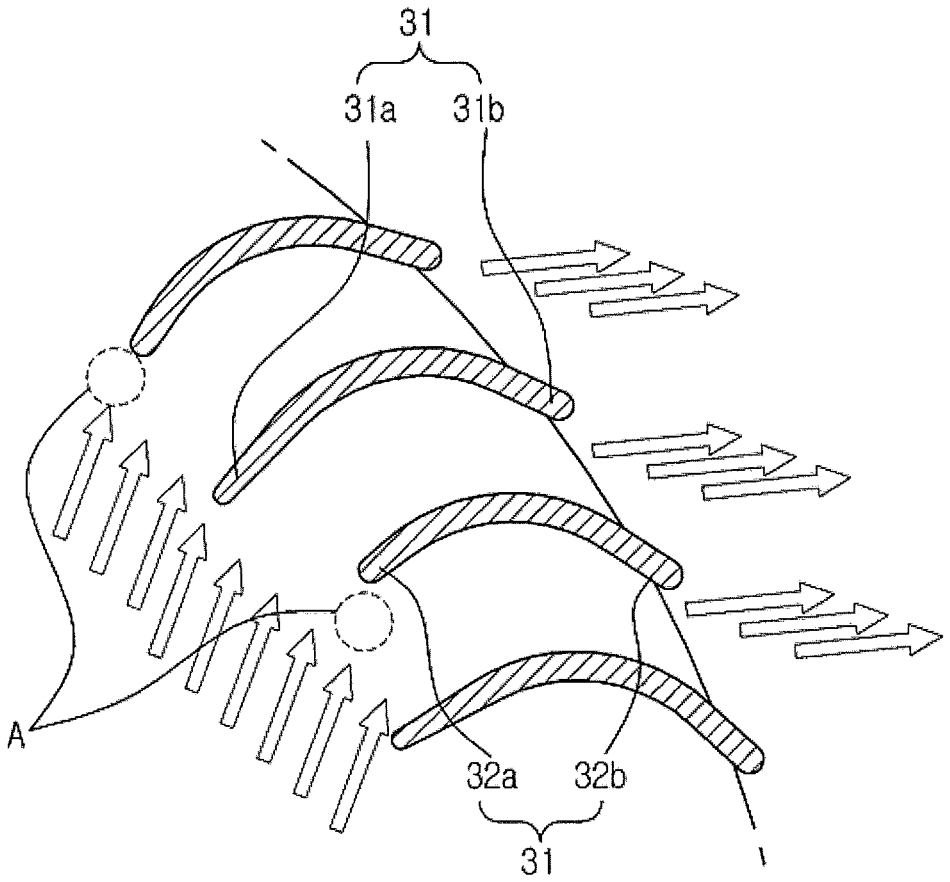
FIG. 7 is a view illustrating flow of air suctioned into and discharged from a centrifugal fan according to one embodiment.

FIG. 6 is a view illustrating a centrifugal fan according to one embodiment, FIG. 7 is a view illustrating flow of air suctioned into and discharged from the centrifugal fan.

As shown in FIGS. 6 and 7, the centrifugal fan 30 may be a multi-blade fan whose blades are inclined in the direction of rotation. The centrifugal fan 30 of this embodiment is a bidirectional centrifugal fan that suctions air in both directions. The centrifugal fan 30 includes a base 35 coupled with the motor shaft 42 and a plurality of blades 31 and 32 to suction and discharge air.

The base 35 may be formed in a disc shape. A coupling hole 33 to which the motor shaft 42 of the motor 41 is coupled may be formed in the central portion of the base 35.

The blades 31 and 32 are disposed spaced apart from each other to guide air introduced in the axial direction of the base 35 to the circumferential direction of the base 35. Each of blades includes a leading edge 31*a*, 32*a* arranged in the direction of the motor shaft 42 and a trailing edge 31*b*, 32*b* arranged in the outer circumferential direction of the base 35. The blades having a leading edge 32*a* shorter than the leading edge 31*a* of the other blades are defined as first blades 32. The blades other than the first blades are defined as second blades 31. The second blades 31 have a leading edge 31*a* longer than that of the first blades 32.

The first blades 32 and the second blades 31 may be alternately arranged. That is, each of the first blades 32 may be disposed between the second blades 31. As the blades 31 and 32 having different lengths are alternately arranged, the discharge angle of air discharged from the blades 31 and 32 may be kept constant, and the suction resistance caused by collision between the blades 31 and 32 and air suctioned into the blades 31 and 32 may be reduced.

That is, a space A through which air is suctioned is produced by arranging the leading edges 31*a* and 32*a* having different lengths, suction resistance of air may be reduced and a desired flow rate may be secured. Thereby, it may be possible to secure a desired flow rate within various ranges of static pressure. The tendency of air ejected near a surface of a wall or a ceiling to flow along the surface is called the Coandă effect. According to the Coandă effect, the air suctioned or discharged through the centrifugal fan 30 flows along the surface of each blade. Accordingly, by the different arrangement of the leading edges 31*a* and 32*a*, the suction resistance of the air may be reduced. In addition, by maintaining the shape of the trailing edges 31*b* and 32*b* through which air is discharged, a desired flow rate may be secured.

Figure 8:
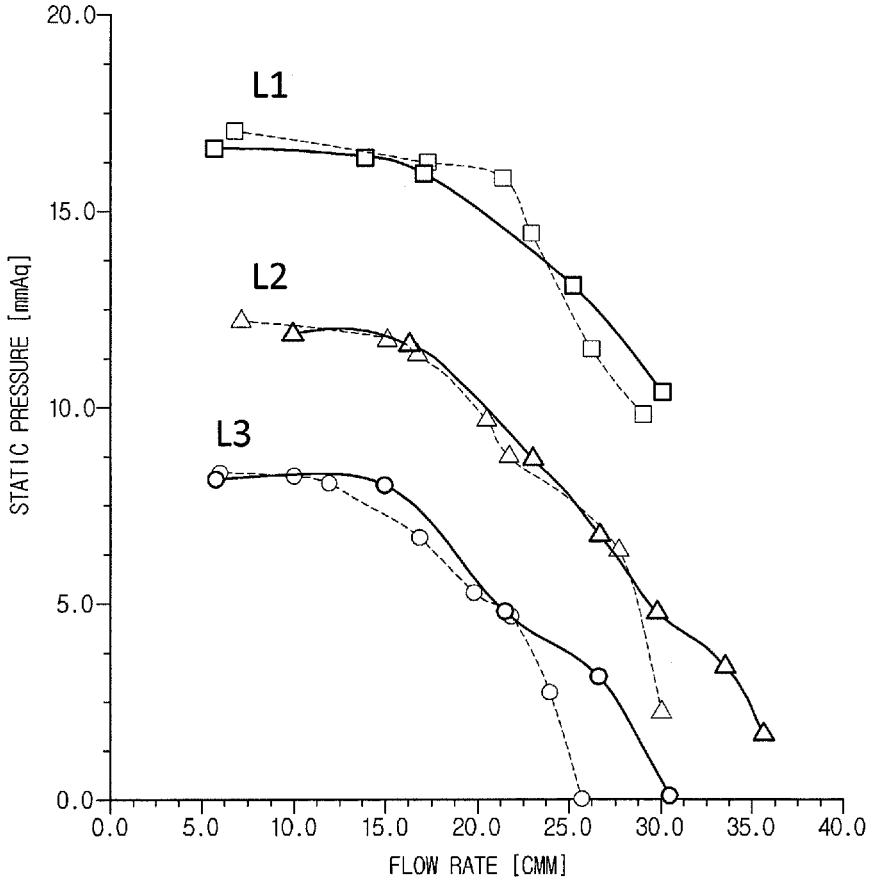
FIG. 8 is a graph comparing flow rates prior to and after improvement of the structure of a centrifugal fan according to one embodiment in various ranges of static pressure.

FIG. 8 is a graph comparing flow rates prior to and after improvement of the structure of a centrifugal fan according to one embodiment in various ranges of static pressure.

In FIG. 8, the solid lines indicate experimental data of flow rates according to the static pressure of the centrifugal fan 30 shown in FIGS. 6 and 7, and the dotted lines indicate flow rates according to the static pressure of a centrifugal fan 30 whose blades have the same length.

Herein, L1 indicates that the centrifugal fan rotates at 1400 revolutions per minute (RPM) and L2 indicates 1200 RPM. L3 indicates 1000 RPM.

As shown in FIG. 8, in the section in which static pressure is high, the flow rate produced by the centrifugal fan according to one embodiment of the present disclosure produces is similar to the flow rate produced by a centrifugal fan whose blades have the same length. However, in the section in which static pressure is low, it is seen that the centrifugal fan according to one embodiment of the present disclosure produces a higher flow rate.

Figure 9:
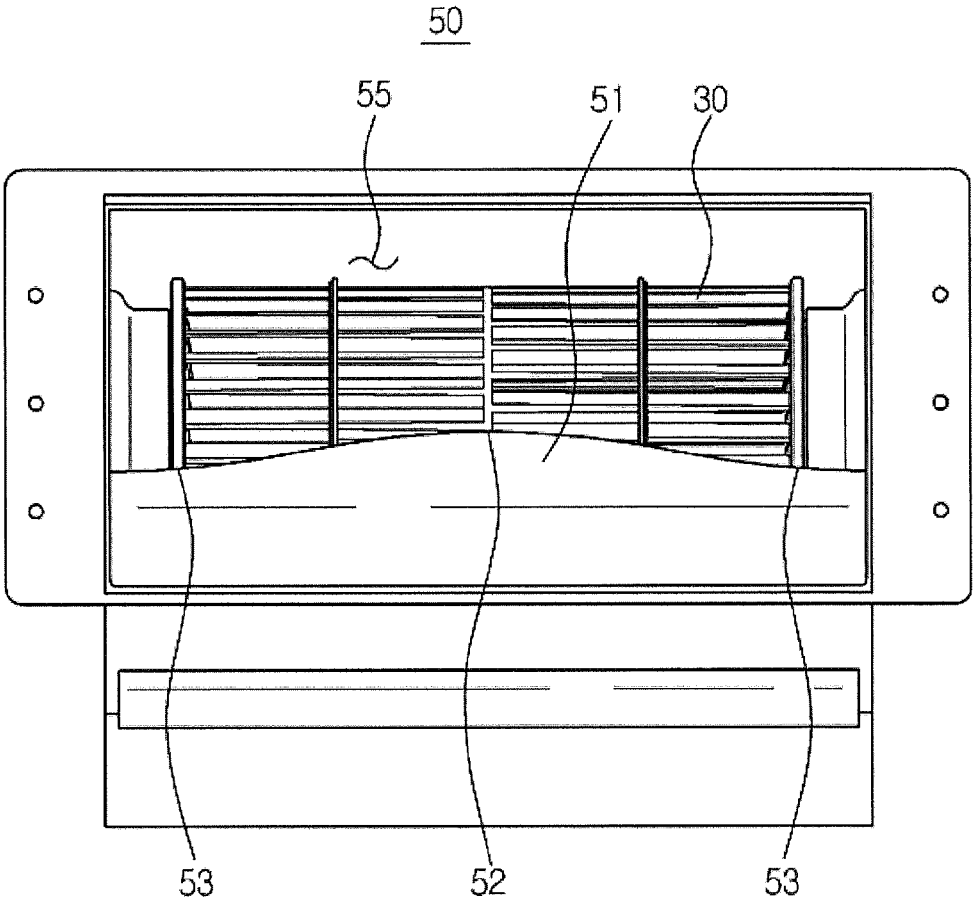
FIG. 9 is a view illustrating a discharge port of an air blowing unit according to another embodiment of the present disclosure.

FIG. 9 is a view illustrating a discharge port of an air blowing unit according to another embodiment of the present disclosure.

Referring to FIG. 9, a cut-off portion 51 provided to the housing discharge port 55 includes a protrusion 52 protruding upward. According to this embodiment, the protrusion 52 may be arranged at the central portion of the housing discharge port 55. The protrusion 52 may protrude in the direction tangential to the circumference of the centrifugal fan 30. In addition, it may be possible for the protrusion 52 to protrude in a radial direction of the centrifugal fan 30. Accordingly, both edge portions 53 of the cut-off portion 51 may have concavely curved surfaces.

Since the protrusion 52 suppresses development of vortices around the housing discharge port 55, it may decrease resistance of air discharged from the housing discharge port 55, reducing loss of air flow.

Figure 10:
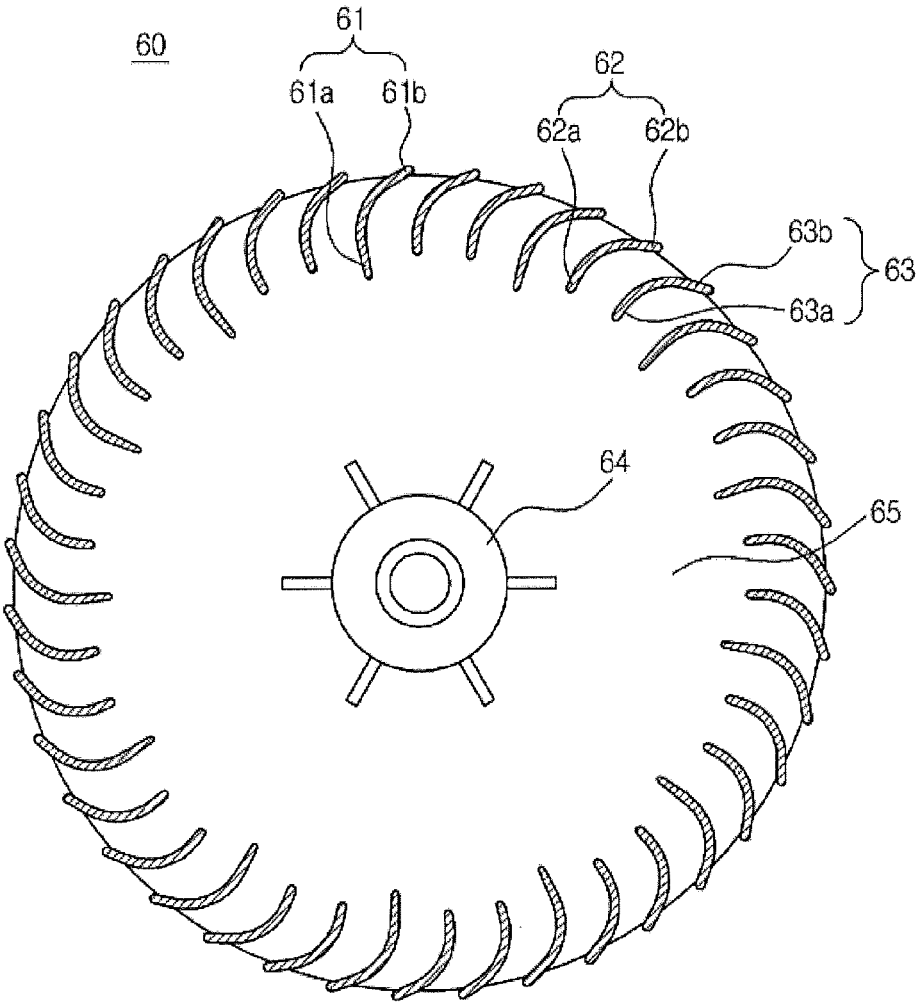
FIG. 10 is a view illustrating a centrifugal fan according to another embodiment of the present disclosure.
Figure 11:
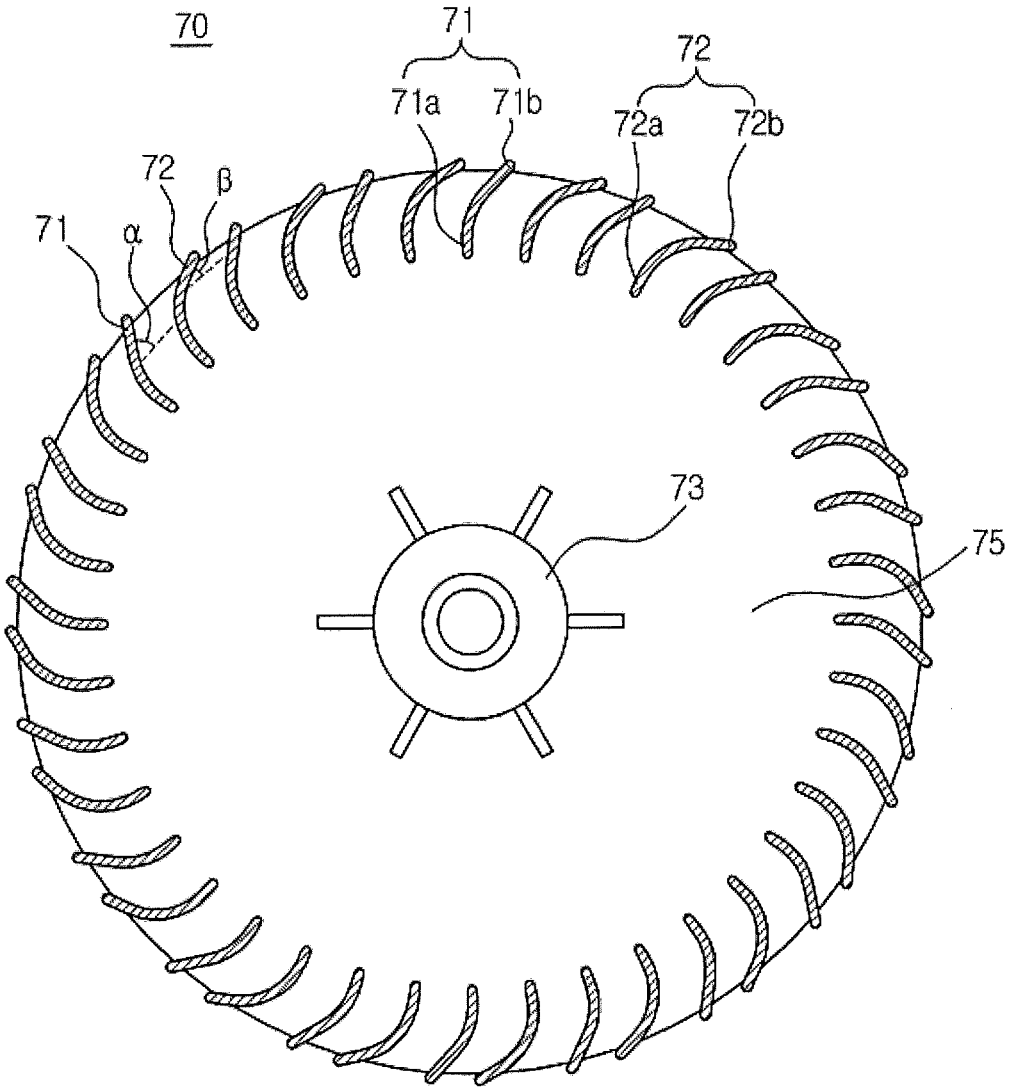
FIG. 11 is a view illustrating a centrifugal fan according to another embodiment of the present disclosure.
Figure 12:
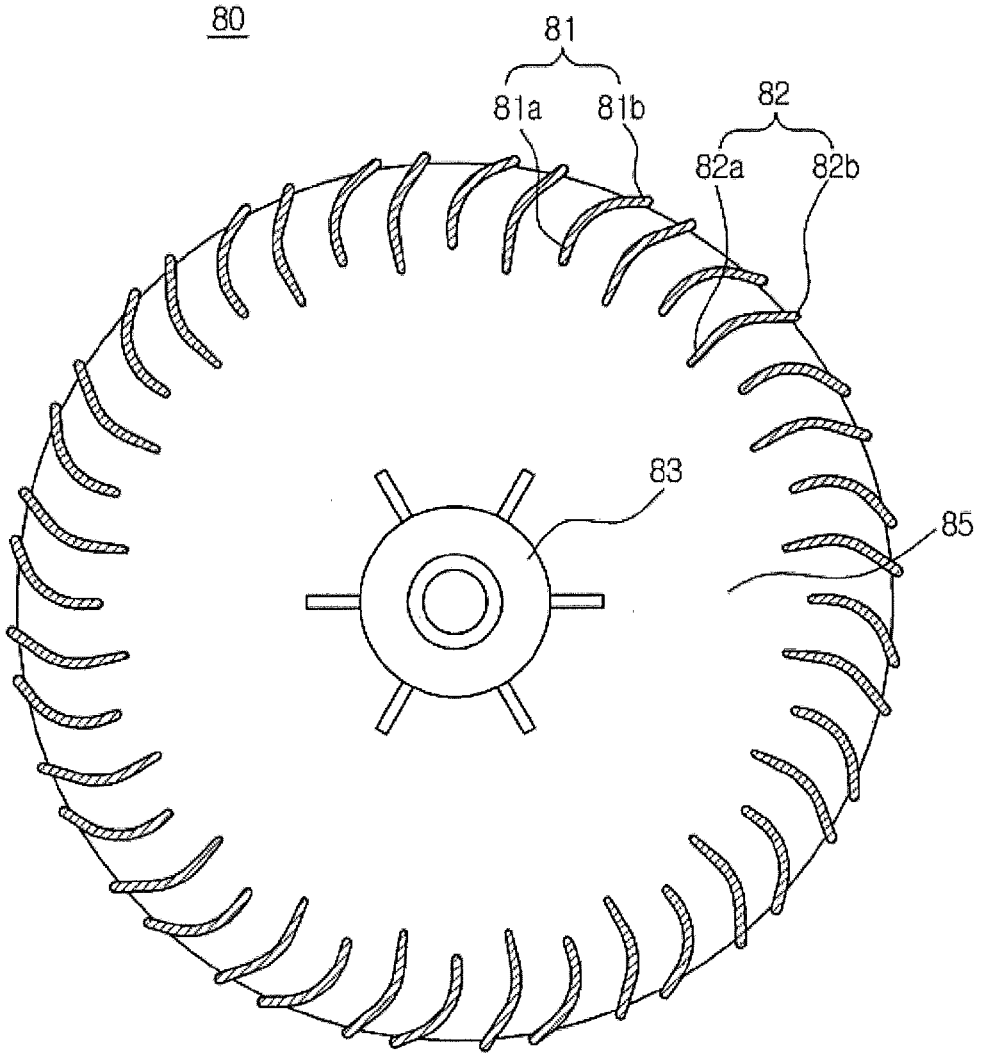
FIG. 12 is a view illustrating a centrifugal fan according to another embodiment of the present disclosure.

FIGS. 10 to 12 are views illustrating a centrifugal fan according to other embodiments of the present disclosure.

As shown in FIGS. 10 to 12, the centrifugal fan may be formed in various shapes.

According to one embodiment illustrated in FIG. 10, a plurality of the first blades 62 and 63 of the centrifugal fan 60 may be arranged between the second blades 61. While two first blades 62 and 63 are illustrated in FIG. 10 as being arranged between the second blades 61. Embodiments of the present disclosure are not limited thereto. Two or more first blades 62 and 63 may be arranged between the second blades. Similar to the earlier described embodiments, each of blades includes a leading edge 61*a*, 62*a*, 63*a* and a trailing edge 61*b*, 62*b*, 63*b*. Further, the centrifugal fan may have a base 65 formed in a disc shape and a coupling hole 64.

According to the embodiment illustrated in FIG. 11, desired flow rates may be secured in various ranges of static pressure by changing the bending angle of the trailing edges 71*b* and 72*b* of the blades 71 and 72 of the centrifugal fan 70 having base 75 and coupling hole 73.

Blades with one of the trailing edges 71*b* and 72*b* having a greater bending angle are defined as first blades 72 and the blades other than the first blades 72 are defined as second blades 71.

When the angle between the trailing edge 72*b* of a first blade 72 and a tangential line of the base 75 is defined as $\alpha$, and the angle between the trailing edge 71*b* of a second blade 71 and a tangential line of the base 75 is defined as β, α is greater than β. That is, the angle of the first blade 72 with respect to the base 75 is greater than the angle of the second blade 71 with respect to the base 75, while the angle by which the first blade 72 is bent from the leading edge 72*a* is greater than the angle by which the second blade 71 is bent from the leading edge 71*a*. According to one embodiment, one first blade 72 is disposed between the second blades 71. However, embodiments of the present disclosure are not limited thereto. It may be possible that plural first blades 72 are disposed between the second blades 71.

By arranging the blades 71 and 72 such that the trailing edges 71*b* and 72*b* are provided with different bending angles, air may be discharged at different discharge angles through the spaces between the blades. A large discharge angle of air is effective at high static pressure, while small discharge angle is effective at low static pressure. According to one embodiment of the present disclosure, the diversified discharge angles are provided, and accordingly the centrifugal fan 70 may provide high flow rate in various ranges of static pressure.

In the embodiment illustrated in FIG. 12 showing a centrifugal fan 80 having base 85 and coupling hole 83, the leading edge 81*a* and the trailing edge 81*b* of the first blade 81 of the centrifugal fan 80 have all been changed.

The leading edge 81*a* of the first blade 81 is designed to be shorter than the leading edge 82*a* of the second blade 82. Thereby, the suction angle of air is varied. In addition, by making the bending angle of the trailing edge 81*b* of the first blade 81 greater than the bending angle of the trailing edge 82*b* of the second blade 82, the discharge angle of air is changed. As the suction angle and discharge angle of air are changed, it may be possible to secure a desired flow rate in various ranges of static pressure.

As is apparent from the above description, improvement of the structure of the blades or housing of a centrifugal fan may allow a user to obtain a desired flow rate in various ranges of static pressure.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. An air blowing unit comprising:

a housing to guide suction and discharge of air; and a centrifugal fan having a base, the centrifugal fan including a plurality of blades comprising first blades and second blades disposed in a circumferential direction of the base, wherein each of the blades includes a leading edge facing an inner circumferential direction of the base, a radial distance between a center of the base and the leading edges of the first blades being greater than a radial distance between the center of the base and the leading edges of the second blades; and a trailing edge facing in an outer circumferential direction of the base, a radial distance between the center of the base and the trailing edges of the first blades being equal to a radial distance between the center of the base and the trailing edges of the second blades, wherein a degree of curvature of the trailing edge with respect to the leading edge of the first blades is greater than a degree of curvature of the trailing edge with respect to the leading edge of the second blades.

2. The air blowing unit according to claim 1, wherein at least one of the first blades is alternately disposed with each of the second blades.

3. The air blowing unit according to claim 1, wherein the housing includes a housing air discharge port, and wherein at least one portion of the housing air discharge port is formed as a curved surface and comprises a protrusion protruding upward of the housing.

4. The air blowing unit according to claim 3, wherein the protrusion is arranged at edges of the air housing discharge port.

5. The air blowing unit according to claim 3, wherein the protrusion is arranged at a central portion of the air housing discharge port.

6. An air conditioner including a cabinet forming an external appearance of the air conditioner and an air blowing unit positioned inside the cabinet, the air blowing unit comprising:

a housing to guide suction and discharge of air;

a centrifugal fan positioned inside the housing; and a motor to drive the centrifugal fan, wherein the centrifugal fan comprises a base coupled to a motor shaft coupled to the motor; and a plurality of blades comprising first and second blades disposed spaced apart from each other in a circumferential direction of the base to guide air introduced in an axial direction of the base to the circumferential direction of the base;

wherein each of the blades includes a leading edge provided to each of the blades and arranged close to the motor shaft, a radial distance between the motor shaft and the leading edges of the first blades being greater than a radial distance between the motor shaft and the leading edges of the second blades; and a trailing edge provided to each of the blades and facing in an outer circumferential direction of the base, a radial distance between the motor shaft and the trailing edges of the first blades being equal to a radial distance between the motor shaft and the trailing edges of the second blades, wherein a degree of curvature of the trailing edge with respect to the leading edge of the first blades is greater than a degree of curvature of the trailing edge with respect to the leading edge of the second blades.

7. The air conditioner according to claim 6, wherein each of the first blades are alternately disposed with at least one of the second blades.

8. The air conditioner according to claim 6, wherein each of the second blades is alternately disposed between at least one of the first blades.

9. The air conditioner according to claim 6, wherein the housing comprises a housing discharge port allowing air to be discharged therethrough, and wherein at least one portion of the housing discharge port is formed as a curved surface and comprises a protrusion protruding upward of the housing.

10. The air conditioner according to claim 9, wherein the protrusion is arranged at edges of the housing discharge port.

11. The air conditioner according to claim 9, wherein the protrusion is arranged at a central portion of the housing discharge port.

12. The air conditioner according to claim 9, wherein the protrusion protrudes in a radial direction of the centrifugal fan.

13. The air conditioner according to claim 9, wherein the protrusion protrudes in a circumferential direction of the centrifugal fan.

* * * * *